US009228367B2

(12) United States Patent
Schoellkopf

(10) Patent No.: US 9,228,367 B2
(45) Date of Patent: Jan. 5, 2016

(54) MODULAR TRADE SHOW BOOTH

(71) Applicant: Shawn Schoellkopf, Dickinson, TX (US)

(72) Inventor: Shawn Schoellkopf, Dickinson, TX (US)

( * ) Notice: Subject to any disclaimer, the term of this patent is extended or adjusted under 35 U.S.C. 154(b) by 0 days.

(21) Appl. No.: 14/048,284

(22) Filed: Oct. 8, 2013

(65) Prior Publication Data

US 2014/0173998 A1 Jun. 26, 2014

Related U.S. Application Data

(60) Provisional application No. 61/711,144, filed on Oct. 8, 2012, provisional application No. 61/715,689, filed on Oct. 18, 2012.

(51) Int. Cl.
*E04H 1/12* (2006.01)
*E04H 3/02* (2006.01)
*E04H 3/10* (2006.01)

(52) U.S. Cl.
CPC ..... *E04H 1/1272* (2013.01); *E04H 3/02* (2013.01); *E04H 3/10* (2013.01)

(58) Field of Classification Search
CPC .. E04B 1/34389; E04B 1/34336; E04H 1/005
USPC ..... 52/63–64, 79.5, 83, 202, 222, 3, 23, 52/79.1, 79.9, 79.12, 656.1, 645–646, 52/648.1, 656.9, 270, 284, 285.1, 285.2, 52/285.3, 285.4, 281; 160/135, 351, 327, 160/368.1, 377, 384, 264; 40/604, 617; 5/414, 504; 135/87, 90, 121, 156, 157, 135/116, 119; 211/191–192; 248/224.7
See application file for complete search history.

(56) References Cited

U.S. PATENT DOCUMENTS

| | | | | | |
|---|---|---|---|---|---|
| 4,373,570 | A * | 2/1983 | Nussdorf et al. | 160/352 |
| 5,768,722 | A * | 6/1998 | Olson et al. | 5/9.1 |
| 5,921,047 | A * | 7/1999 | Walker | 52/585.1 |
| 6,014,842 | A * | 1/2000 | Matsubara | 52/79.12 |
| 6,047,509 | A * | 4/2000 | Savoie | 52/281 |
| 6,058,660 | A * | 5/2000 | Melton | 52/71 |
| 6,386,657 | B1 * | 5/2002 | Frifeldt | 312/265.1 |
| 6,494,247 | B1 * | 12/2002 | Pedone | 160/135 |
| 6,609,336 | B2 * | 8/2003 | Matsubara | 52/79.12 |
| 6,659,159 | B2 * | 12/2003 | Fritsche et al. | 160/371 |
| 6,871,614 | B2 * | 3/2005 | Goldwitz et al. | 119/436 |
| 6,959,515 | B1 * | 11/2005 | Beighton | 52/79.9 |
| 7,076,922 | B1 * | 7/2006 | Parres | 52/79.5 |
| 7,389,618 | B1 * | 6/2008 | Herkstroeter et al. | 52/285.3 |
| 7,461,485 | B2 * | 12/2008 | Toledo | 52/222 |
| 2001/0010232 | A1 * | 8/2001 | Zheng | 135/126 |
| 2004/0074155 | A1 * | 4/2004 | Toledo | 52/36.1 |
| 2009/0014044 | A1 * | 1/2009 | Hartman et al. | 135/143 |
| 2009/0313925 | A1 * | 12/2009 | Lyons et al. | 52/274 |
| 2012/0311902 | A1 * | 12/2012 | Ceurvels | 40/606.01 |

* cited by examiner

*Primary Examiner* — Beth Stephan
(74) *Attorney, Agent, or Firm* — Joseph M. Jong

(57) ABSTRACT

A modular trade show booth includes a plurality of frame structures connected to form a floor support frame, a first wall support frame and a second wall support frame. A floor panel disposed on the floor support frame. A first wall panel disposed on the first wall support frame, and second wall panel disposed on the second wall support frame. A panel hanger may be attached to the wall panel to facilitate hanging the wall panel on the first wall support frame.

13 Claims, 4 Drawing Sheets

MODULAR TRADE SHOW BOOTH

CROSS-REFERENCE TO RELATED APPLICATIONS

This application claims priority to U.S. Provisional Application No. 61/711,144 filed on Oct. 8, 2012 and U.S. Provisional Application No. 61/715,689 filed on Oct. 18, 2012. Each related application is hereby incorporated by reference in its entirety.

BACKGROUND

Trade show booths typically require substantial time and effort to assemble. Particularly for a trade show booth exhibit that is elaborate or built like a show room, a construction crew of at least three people may be required to assemble the trade show booth in a reasonable amount of time (e.g., one working day). Even with a large crew, a typical trade show booth may still take longer than a desirable time to assemble.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the invention provide a modular trade show booth system in which booth structure and prefabricated walls and floors may be assembled in a short amount of time to provide a strong, well designed and aesthetically pleasing trade show booth. One embodiment of the invention facilitates easy and quick assembly of a trade show booth by two people or even by just one person. The trade show booth includes panel hangers (also referred herein as booth structure hangers) to hang prefabricated walls and lay prefabricated floors quickly while maintaining strength, quality and aesthetics. In some instances, two people may be able to assemble the trade show booth structure according to embodiments of the invention in less than one hour. The time required to assemble the trade show booth structure depends on the overall size of the booth. After assembly of the trade show booth structure, prefabricated wall panels may be hung utilizing the panel hangers, and prefabricated floor panels may also be attached to the booth structure utilizing the panel hangers. The trade show booth may be completely assembled under 3 hours. Additional time may be required for tweaks and decorations to provide professional show room aesthetics.

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Figure 1:
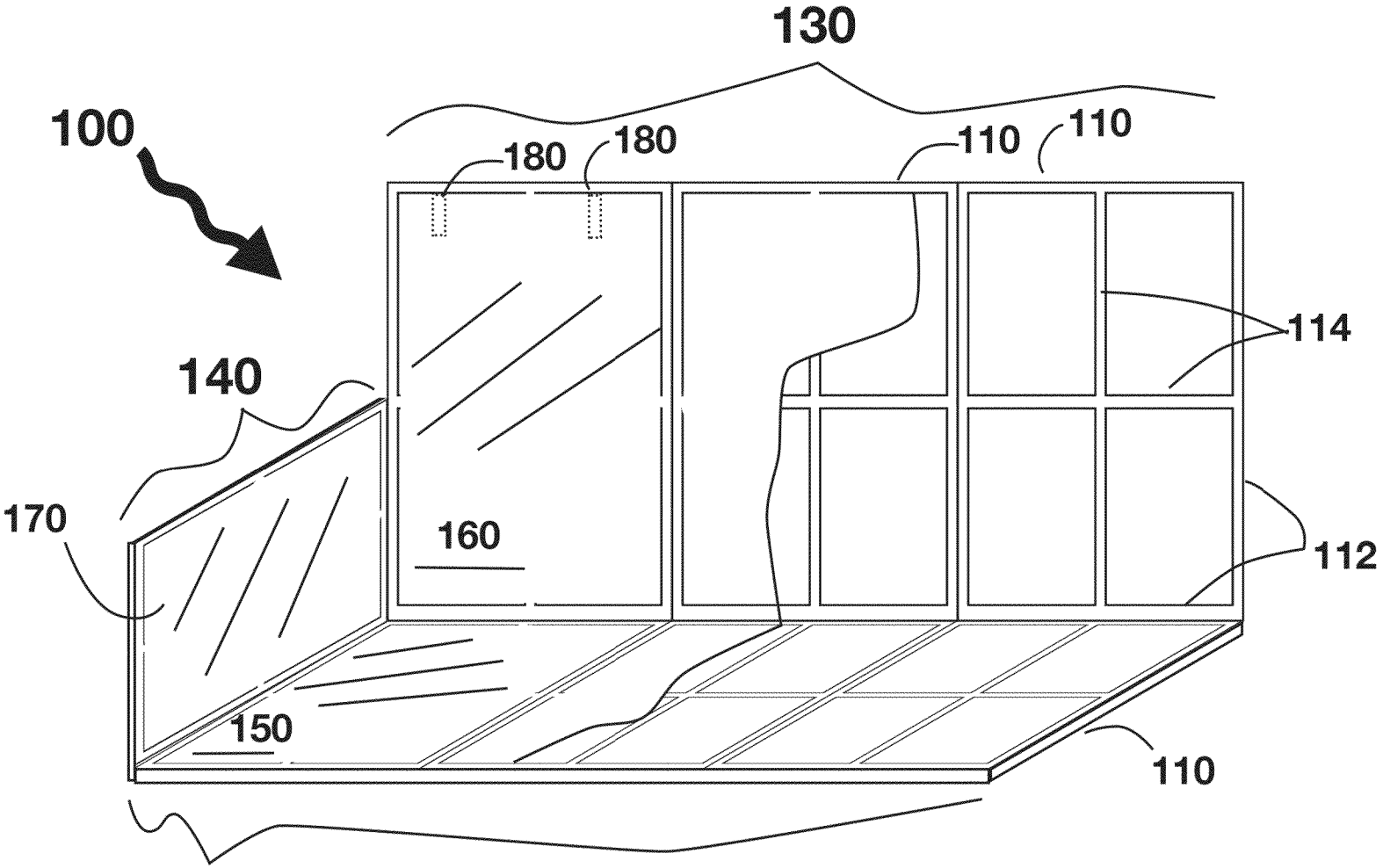
FIG. 1 is a perspective view of a modular trade show booth according to one embodiment of the invention.

FIG. 1 is a perspective view of a modular trade show booth according to one embodiment of the invention. In one embodiment, the modular trade show booth 100 comprises a plurality of frame structures 110 connected to form a floor support frame 120, a first wall support frame 130 and a second wall support frame 140. Each frame structure may be identically shaped to facilitate manufacturing efficiency as well as easy assembly of the trade show booth. For example, each frame structure 110 may comprise an outer frame 112 and one or more braces 114 and may be sized correspondingly to fit an industry standard 4 ft by 8 ft board. In another embodiment, frame structure may comprise an outer back wall frame, an inner back wall frame, an outer floor frame, an inner floor frame, a left side frame and a right side frame, wherein each of these types of frames are dimensioned differently to accommodate the thickness of the frame according to the way the frames are joined (e.g., butt joints). Alternatively, differently shaped and/or sized frame structures may be provided to form one or more of the floor support frame 120, the first wall support frame 130 and the second wall support frame 140. For example, each frame structure may be sized as a fraction or a multiple of a selected size. In the example above wherein a selected size is the 4 ft by 8 ft board, additional frame structures may be sized correspondingly to fit 4 ft by 4 ft board, 2 ft by 8 ft board, 2 ft by 4 ft board, etc. In other embodiments, the frame structures may be customized according to the required trade show booth specifications (e.g., width of 10' and length of 10', 20', 30', 40', etc.).

Figure 2:
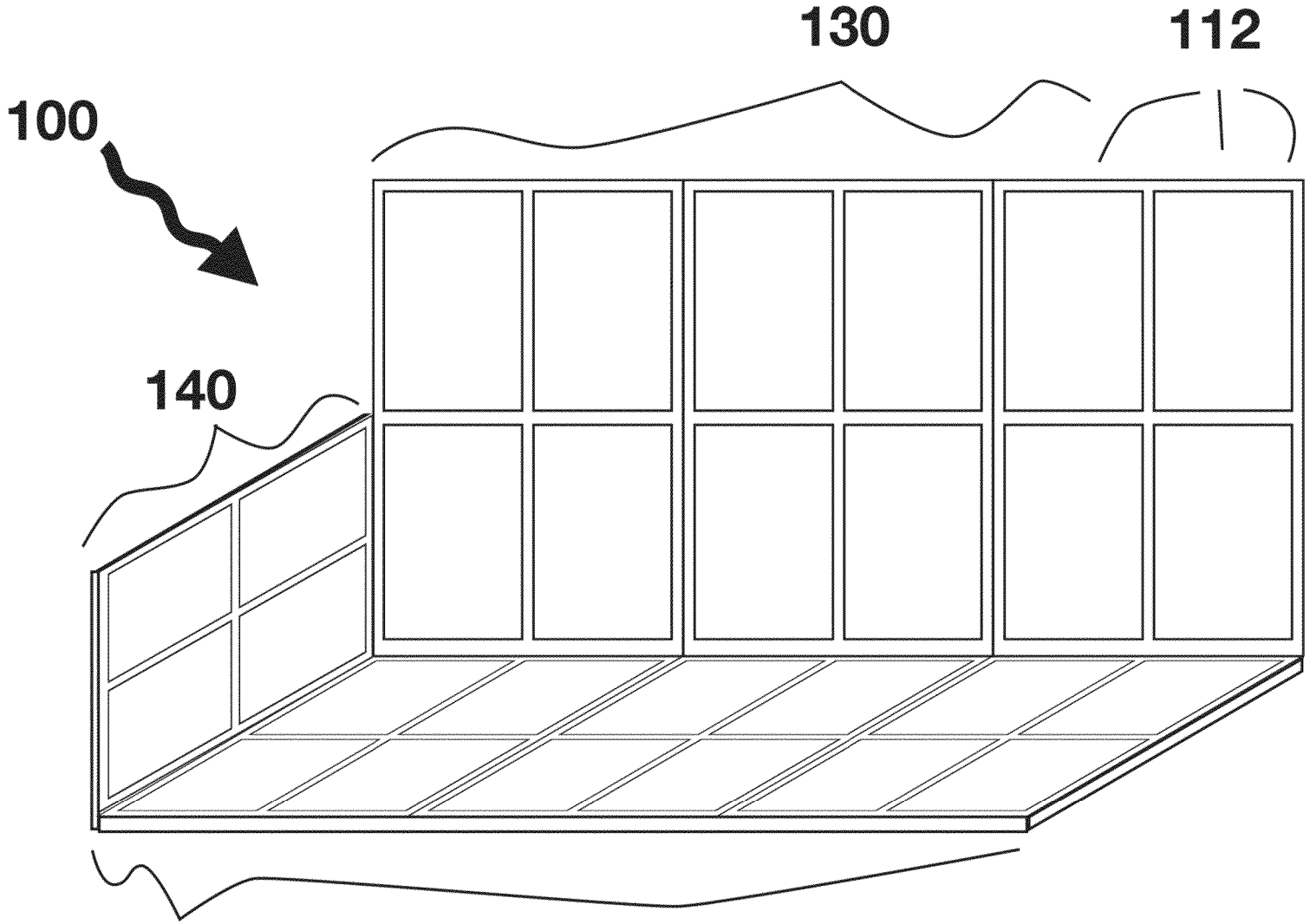
FIG. 2 is a perspective view of a plurality of frame structures forming a modular trade show booth according to one embodiment of the invention.
Figure 3:
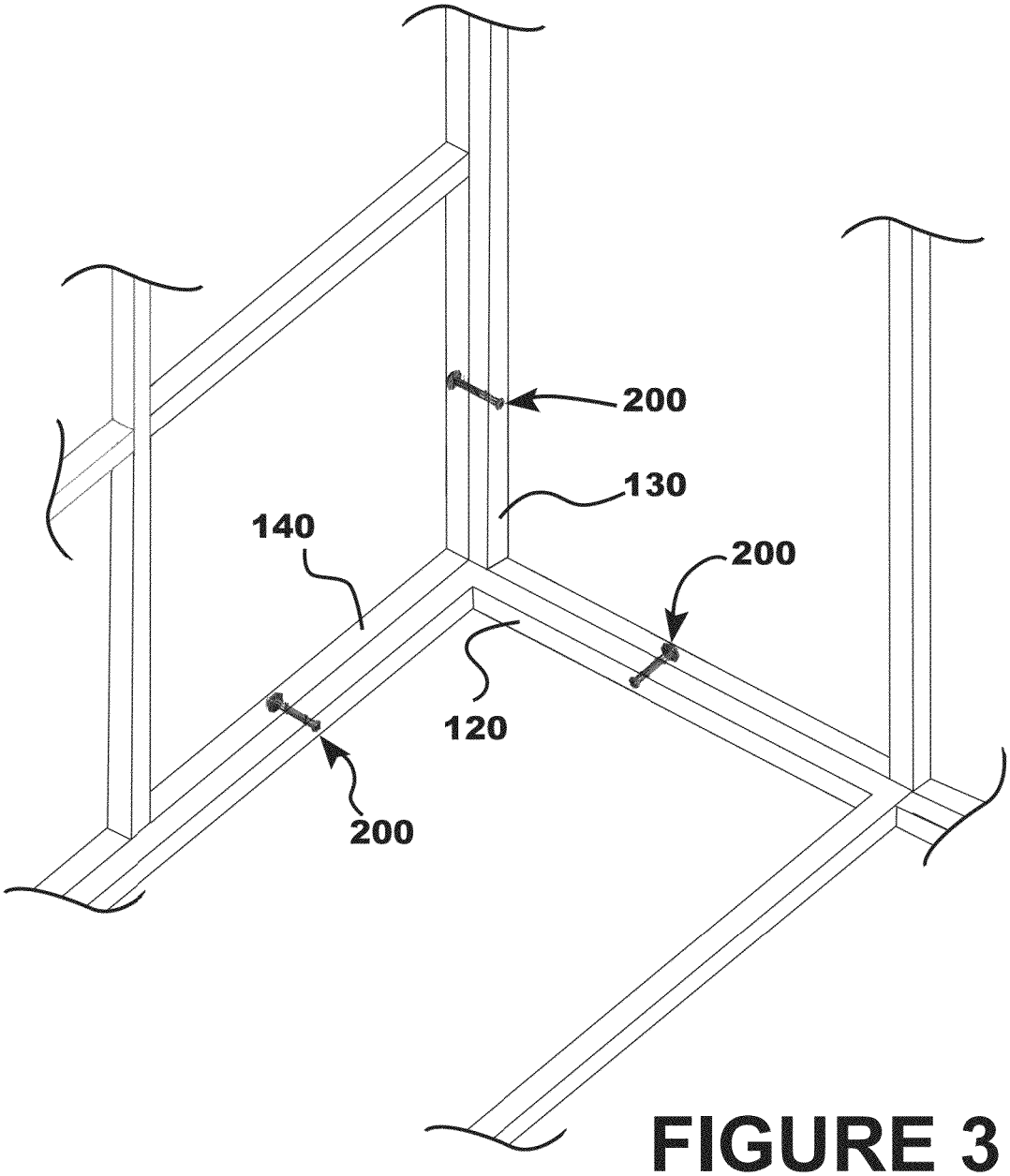
FIG. 3 is a perspective view of a corner joint of a modular trade show booth according to one embodiment of the invention.

FIG. 2 shows a perspective view of a plurality of frame structures forming a modular trade show booth according to one embodiment of the invention. FIG. 3 shows a perspective view of a corner joint of a modular trade show booth according to one embodiment of the invention. Each frame structure may comprise metal tubes cut to desired dimensions and welded together. The metal tubes may be made of an inexpensive light metal such as aluminum. For example, 2 inch square aluminum tubing may be cut to desired specifications and welded to form the frame structure as shown in the drawings. The size of the metal tubing may be increased (e.g., 2.5", 3", 4", etc.) or decreased according to the desired structural strength requirements. Other metals may be utilized according to the desired combination of structural strength, weigh, cost, ease of manufacturing and ease of transportation. In one alternative embodiment, corner reinforcement metal pieces may be welded at the corner joints of the frame structures to enhance structural integrity of the frame structure.

Each frame structure includes a plurality of holes which may be drilled in specified locations to facilitate attachment to other frame structures. A plurality of fasteners 200 (e.g., bolts/nuts, screws, clips, ties, etc., and any combination of fasteners) may be utilized to secure the plurality frame structures to each other. In one embodiment, a first frame structure 120 is positioned horizontally on the floor, and a second frame structure 140 is position vertically and secured via fasteners 200 (such as stainless steel bolts and nuts) to a first edge portion of the first frame structure 120. A third frame structure 130 is positioned vertically and secured via fasteners 200 to a second edge portion of the first frame structure. The third frame structure is also secured via fasteners 200 to the second frame structure.

A floor panel 150 is disposed on the floor support frame 120 and may be secured to the floor support frame 120 utilizing fasteners. A first wall panel 160 is disposed on the first wall support frame 130 to form a back wall. A second wall panel 170 is disposed on the second wall support frame. In one embodiment, a panel hanger 180 is attached (e.g., fastened, screwed glued, etc.) to a back side of the first wall panel 160, and the first wall panel 160 is hung on the first wall support frame 130.

Figure 4:
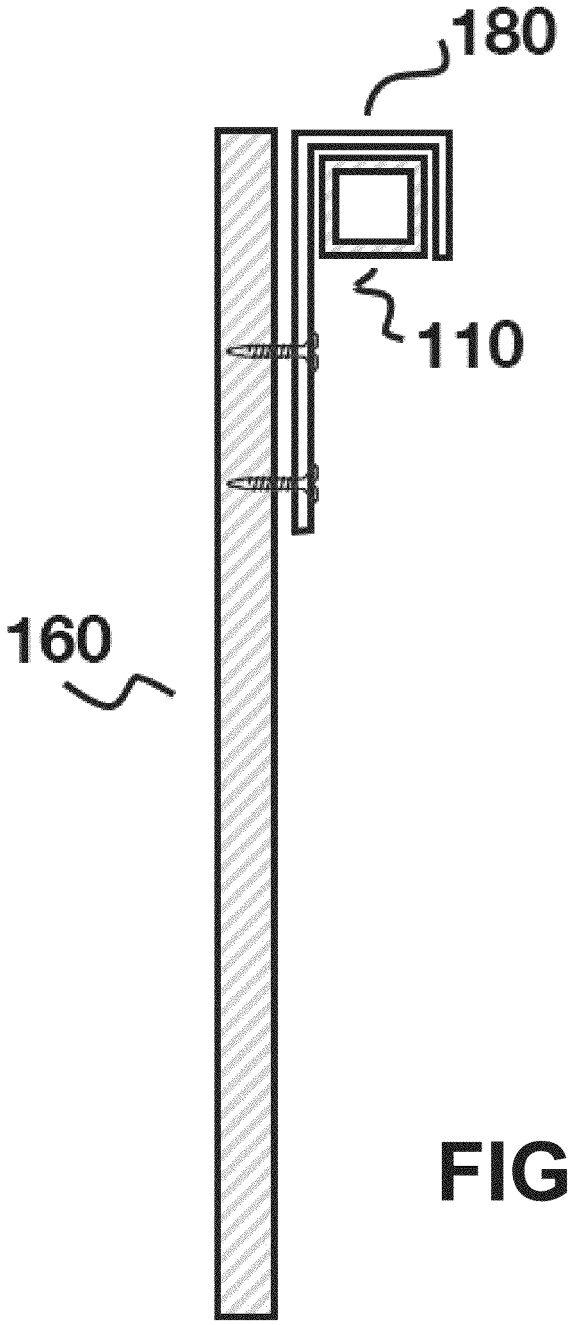
FIG. 4 is a cross sectional view of a panel and a panel hanger of a modular trade show booth according to one embodiment of the invention.

FIG. 4 is a cross sectional view of a panel and a panel hanger of a modular trade show booth according to one embodiment of the invention. The panel hanger 180 may be shaped as a hook that conforms to the top portion and the side portions of an edge portion of the frame structure 110. Alternatively, the panel hanger 180 may comprise a metal plate (e.g., ¼" thick aluminum) which is bent to conform to the top portion and the side portions of an edge portion of the frame structure 110. The width or size of the plate may depend on the number of panel hangers utilized for hanging each wall panel. In one embodiment the panel hanger is attached to the wall panel utilizing screws.

In another embodiment, a plurality of trade show booths may be connected together. Other uses of the modular trade show booth may include theater sets, movie/film sets, background sets for video interviews, news cast, and other events and/or performances.

While the foregoing is directed to embodiments of the present invention, other and further embodiments of the invention may be devised without departing from the basic scope thereof, and the scope thereof is determined by the claims that follow.

What is claimed is:

1. A modular trade show booth, comprising:

a plurality of frame structures connected to form a floor support frame, a first wall support frame and a second wall support frame, wherein each individual frame structure comprises an outer frame and one or more braces connected to an internal portion of the outer frame;

a floor panel disposed on the floor support frame;

a first wall panel disposed on the first wall support frame;

a panel hanger attached to the first wall panel, wherein the first wall panel is hung on the first wall support frame; and a second wall panel disposed on the second wall support frame.

2. The modular trade show booth of claim 1, wherein all of the plurality of frame structures are identically shaped.

3. The modular trade show booth of claim 1, wherein the plurality of frame structures comprises:

a back wall frame;

a floor frame; and a side wall frame, wherein a height of the back wall frame is about the same as the length of the floor frame and about the same as the length of the side wall frame.

4. The modular trade show booth of claim 1, further comprising fasteners for securing the plurality frame structures to each other.

5. The modular trade show booth of claim 1, wherein each frame structure comprises a plurality of metal tubes welded together.

6. The modular trade show booth of claim 5, wherein the metal tubes comprises 2-inch square aluminum tubes.

7. The modular trade show booth of claim 1, wherein each frame structure is sized correspondingly to fit a 4' by 8' wall panel.

8. A modular trade show booth, comprising:

a plurality of frame structures connected to form a floor support frame, a first wall support frame and a second wall support frame, wherein each individual frame structure comprises an outer frame and one or more braces connected to an internal portion of the outer frame;

a floor panel disposed on the floor support frame;

a first wall panel disposed on the first wall support frame; and a second wall panel disposed on the second wall support frame;

wherein the plurality of frame structures comprises:

a back wall frame;

a floor frame; and a side wall frame, wherein a height of the back wall frame is about the same as the length of the floor frame and about the same as the length of the side wall frame, and wherein the height of the back wall frame is about twice the height of the side wall frame.

9. A method for forming a trade show booth, comprising:

connecting a plurality of frame structures to form a floor support frame, a first wall support frame and a second wall support frame, wherein each individual frame structure comprises an outer frame and one or more braces connected to an internal portion of the outer frame;

disposing a floor panel on the floor support frame;

disposing a first wall panel on the first wall support frame, wherein the first wall panel is hung on the first wall support frame using a panel hanger attached to the first wall panel; and disposing a second wall panel on the second wall support frame.

10. The method of claim 9, wherein the plurality of frame structures comprises:

a back wall frame;

a floor frame; and a side wall frame, wherein a height of the back wall frame is about the same as the length of the floor frame and about the same as the length of the side wall frame.

11. The method of claim 9, wherein all of the plurality of frame structures are identically shaped.

12. The method of claim 9, wherein the plurality of frame structures are secured to each other via fasteners.

13. A method for forming a trade show booth, comprising:

connecting a plurality of frame structures to form a floor support frame, a first wall support frame and a second wall support frame, wherein each individual frame structure comprises an outer frame and one or more braces connected to an internal portion of the outer frame;

disposing a floor panel on the floor support frame;

disposing a first wall panel on the first wall support frame; and disposing a second wall panel on the second wall support frame;

wherein the plurality of frame structures comprises:

a back wall frame;

a floor frame; and a side wall frame, wherein a height of the back wall frame is about the same as the length of the floor frame and about the same as the length of the side wall frame, and wherein the height of the back wall frame is about twice the height of the side wall frame.

* * * * *